US005232088A

United States Patent [19]

Leondidis

[11] Patent Number: 5,232,088

[45] Date of Patent: Aug. 3, 1993

[54] GREETING CARD PUZZLE KIT

[76] Inventor: Alexander A. Leondidis, 5770 W. Irlo Bronson Memorial Hwy., Kissimmee, Fla. 34746

[21] Appl. No.: 833,662

[22] Filed: Feb. 11, 1992

[51] Int. Cl.[5] ..... B65D 69/00

[52] U.S. Cl. ..... 206/223; 206/575; 206/579; 273/157 R

[58] Field of Search ..... 206/223, 232, 460, 575, 206/579; 229/92.8; 273/157 R, 157 A

[56] References Cited

U.S. PATENT DOCUMENTS

| | | | |
|---|---|---|---|
| 3,398,614 | 8/1968 | Cleary | 273/157 R |
| 3,677,399 | 7/1972 | Tatar | 229/92.8 |
| 4,140,317 | 2/1979 | Ramney | 273/157 R |
| 4,323,154 | 4/1982 | Brandenfels | 229/92.8 |
| 4,612,220 | 9/1986 | Baxter | 273/157 R |
| 4,807,807 | 2/1989 | Glick | 229/92.8 |
| 4,844,246 | 7/1989 | Harrison et al. | 206/460 |
| 4,953,780 | 9/1990 | Ross | 229/92.8 |
| 4,992,050 | 2/1991 | Edwards | 206/575 |
| 5,156,698 | 10/1992 | Roberts | 229/92.8 |

*Primary Examiner*—David T. Fidei
*Attorney, Agent, or Firm*—Richard C. Litman

[57] ABSTRACT

A kit including an assembled puzzle allows the sender to inscribe a message or the like on the back surface of the assembled puzzle, then disassemble the puzzle and send the disassembled puzzle and instructions to a recipient. The recipient must then reassemble the puzzle in order to determine the message inscribed upon the puzzle back surface by the sender. A card included in the kit provides instructions to the recipient, and may also include either a preprinted message or space for a further message by the sender. If the recipient wishes, he or she may use a transparent adhesive sheet provided with the kit to keep the puzzle in a permanently assembled state, and the adhesive sheet may provide an extension in order to secure the permanently assembled puzzle to the card in the manner of a conventional greeting card, if the recipient so desires.

7 Claims, 2 Drawing Sheets

GREETING CARD PUZZLE KIT

FIELD OF THE INVENTION

This invention relates generally to birthday, Christmas, and other types of greeting or holiday cards, and more specifically to such a card upon which a message may be placed and then the card disassembled by the sender for reassembly by the recipient.

BACKGROUND OF THE INVENTION

Puzzles are a popular avocation with many people, particularly the type known as jigsaw puzzles in which a relatively large number of interlocking small pieces may be assembled to form a completed planar sheet displaying a scene or other pattern. Generally, such jigsaw puzzles tend to be relatively large and composed of a large number of pieces, requiring several hours of time for assembly and precluding ease of display as well as having other drawbacks.

In another field, greeting cards have become ever more popular and the competition among manufacturers of such cards has led to a proliferation of cards for virtually every imaginable occasion. The search for ever more clever and attention getting devices with such cards has resulted in virtually every imaginable preprinted message with such cards, and some manufacturers have invented various fold out or other non planar cards in order to provide further entertainment for the recipient when the card is opened.

However, relatively little has been accomplished in the combining of the above two fields. In view of the ever increasing need for greater variety in the greeting card field, the need arises for a greeting card which may include a combined jigsaw puzzle and personalized message by the sender. The puzzle should come in an assembled state, enabling the sender to inscribe any message he or she wishes on the back of the puzzle, which puzzle may then be disassembled for reassembly and viewing of both the puzzle and message by the recipient. Means should be provided for permanent assembly and display of the puzzle and message, in a manner similar to that of conventional greeting cards.

DESCRIPTION OF THE RELATED ART

J. S. Cleary U.S. Pat. No. 3,398,614 issued Aug. 27, 1968 discloses a Method And Apparatus For Cutting Jigsaw Puzzles. The patent is primarily directed to a machine for the manufacture of such puzzles. No closer relationship is seen to the present invention.

F. J. Tatar U.S. Pat. No. 3,677,399 issued Jul. 18, 1972 discloses a Puzzle Postcard. The puzzle is pre-wrapped in an assembled state, and the sender has no access to the puzzle in order to inscribe a message or the like. No challenge is presented to the recipient, as the puzzle is received in a completed state. Moreover, no means is provided for the permanent assembly of the puzzle for display, as in the present invention.

T. J. Ramney U.S. Pat. No. 4,140,317 issued Feb. 20, 1979 discloses a Containerized Greeting Card And Game Toy. The patent is directed primarily to an envelope or closure device for the containment and mailing of such games or toys. While the puzzle embodiment may be transmitted in a disassembled state, the sender would have to complete the assembly of the puzzle, inscribe a message, and again disassemble the puzzle before mailing. Moreover, no means is provided for the display of any message on the reverse side of such a puzzle, or for the permanent assembly of such a puzzle in the form of a greeting card, as in the present invention.

C. Brandenfels U.S. Pat. No. 4,323,154 issued Apr. 6, 1982 discloses a Folded Box With Puzzle. The intent is to provide a box which contains an assembled puzzle in a planar form, unlike the present invention which provides for the transmittal of the puzzle in a disassembled state.

G. H. Baxter U.S. Pat. No. 4,612,220 issued Sep. 16, 1986 discloses Jigsaw Message pads. The puzzle is initially provided in an assembled state and remains in such assembled state throughout the inscription of the message, transmittal of the message to another party, and reception of the message by the other party.

None of the above noted patents, either singly or in combination, are seen to disclose the specific arrangement of concepts disclosed by the present invention.

SUMMARY OF THE INVENTION

By the present invention, an improved puzzle or game in combination with a greeting card is disclosed.

Accordingly, one of the objects of the present invention is to provide an improved puzzle or game in the form of a jigsaw puzzle in combination with such a greeting card.

Another of the objects of the present invention is to provide such a combination puzzle and card upon which the sender may inscribe a message on the reverse side.

Yet another of the objects of the present invention is to provide such a combination puzzle and card which may be disassembled by the sender in order to provide challenge and stimulation to the recipient.

Still another of the objects of the present invention is to provide such a combination puzzle and card which requires the recipient to assemble the puzzle in order to see any message or design which may have been inscribed upon the reverse side of the puzzle.

A further object of the present invention is to provide such a combination puzzle and card which includes means for the permanent reassembly of the puzzle.

An additional object of the present invention is to provide such a combination puzzle and card which includes means for the display of the reassembled puzzle and any message or design inscribed upon the reverse side of the puzzle.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
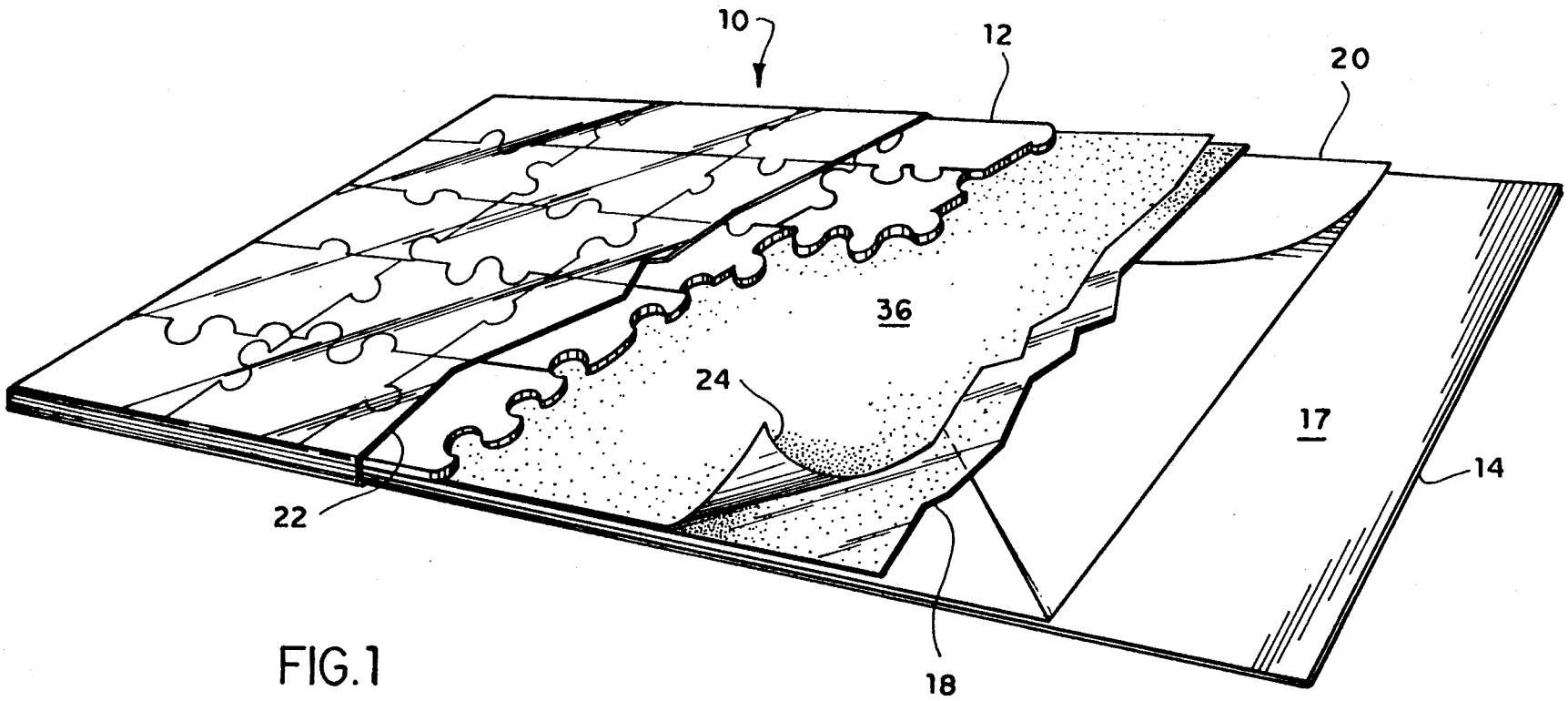
FIG. 1 is a partially fragmented perspective view of the components of the present invention in their packaged state, prior to use by the sender.
Figure 3:
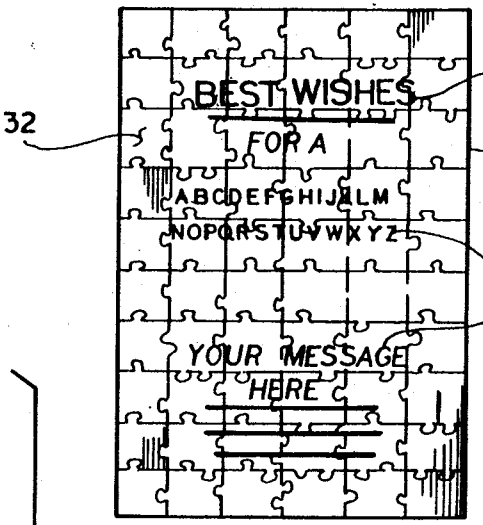
FIG. 3 is a plan view of the back of the assembled puzzle of FIG. 1, showing a typical message which may be inscribed thereupon by the sender.

Referring now to the drawings, particularly FIG. 1 of the drawings, the present invention will be seen to relate to a kit 10 comprising a disassembleable and reassembleable planar puzzle 12 or the like, a card 14 containing instructions or other indicia 16 upon a top or first surface 17, a transparent adhesive backing sheet 18 for the permanent reassembly of puzzle 12, an envelope 20 for the mailing or other transmittal of the components of kit 10, and an outer wrapper or container 22 for the packaging of the above listed components of kit 10. Adhesive backing sheet 18 will be seen to further include a removable protective cover 24, which cover 24 may be removed from adhesive sheet 18 and used for the permanent reassembly of puzzle 12 as will be discussed further below.

Kit 10 will preferably be provided with a transparent wrapper 22 in order that the sender of the kit 10 will be able to see the specific design or picture appearing upon puzzle 12 in order to make an appropriate selection. Obviously, puzzle 12 may be provided in a multitude of different patterns and designs to suit virtually any taste or occasion. By further placing card 14 on the bottom of the kit 10, any message 26 preprinted upon the second or lower side 28 will be visible through a transparent wrapper 22 in order that the sender of kit 10 will be able to make a further selection of an appropriate message. Alternatively, the second side 28 of card 14 may be left blank for the sender to inscribe a message 26 if desired.

When a suitable kit 10 has been selected by the sender, outer wrapper 22 may be removed in order to provide access to the contents of kit 10. It will be evident that at this point, if not earlier, it is desirable to provide some means for the maintenance of puzzle 12 in an assembled state, in order that the sender will be able to inscribe any desired message 30 upon the back 32 of puzzle 12 without first having to assemble puzzle 12. In order to maintain puzzle 12 in an assembled state within the packaging or wrapper 22, and for at least long enough to permit the inscription of a message 30 upon the back surface 32 of puzzle 12, an additional layer of a light, single use adhesive 34 (a light layer of contact cement, adhesive as used with adhesive type note pads, etc.) may be provided to the top surface 36 of protective cover 24, or alternatively another sheet (not shown) may be used for that purpose. The light, single use adhesive 34 will serve to maintain the integrity of puzzle 12 while it is being removed from the packaging and separated from the remainder of the components of kit 10.

At this point, the sender of puzzle 12 may invert puzzle 12, placing the back surface 32 facing upward, and inscribe any message 30 he or she may wish upon the back surface 32 of puzzle 12. Puzzle 12 may then be removed from the single use adhesive surface 34 and disassembled, and the individual pieces of puzzle 12 placed within envelope 20, along with backing sheet 18 and card 14, for transmittal to the recipient. An alternative arrangement of the components of kit 10 provides for adhesive sheet 18 to be of a greater width than assembled puzzle 12, thus providing for an edge 38 which may be used to secure adhesive sheet 18 to the second side 28 of card 14. This may be accomplished either upon the initial assembly of kit 10 prior to use by the sender, by the sender prior to transmittal to the recipient, or by the recipient after reassembly of puzzle 12, but preferably will be accomplished prior to use by the sender.

When the recipient receives the envelope 20 containing the transmitted components of kit 10, he or she will find therein a disassembled puzzle 12, a card 14 which may contain a further message 26 upon a second surface 28 and instructions or other message 16 upon a top or first surface 17, a transparent adhesive backing sheet 18 and protective cover 24, which backing sheet 18 may further provide an extended edge 38 secured or securable to card 14. This assembly of adhesive backing sheet 18 secured to one edge of card 14 by means of extended edge 38, will be seen to provide two planar sheets joined along a common edge by adhesive extended edge 38, in a manner resembling the typical greeting card. When the arrangement is opened, the second side 28 of card 14 will be visible with any message 26 which may have been preprinted or inscribed by the sender thereupon.

However, any further message 30 will be seen to be in a cryptic sate, due to the disassembled nature of the puzzle 12 upon the back 32 of which message 30 is inscribed. In order to determine the nature of message 30, puzzle 12 must be assembled by the recipient of kit 10. Thus, the value of puzzle 12 is twofold: The well known enjoyment and challenge which accompanies the assembly of such a puzzle 12, and further the challenge of solving the mystery or riddle of the message 30 which was inscribed upon the assembled puzzle 12 by the sender prior to disassembly and transmittal of puzzle 12.

When the recipient has completed the assembly of puzzle 12, he or she may invert puzzle 12 to read the message 30 inscribed upon the back 32 of puzzle 12. In the event that the recipient wishes to permanently retain the assembled puzzle 12 and accompanying message 30, the protective cover 24 of transparent adhesive backing sheet 18 may be removed and the adhesive surface placed in registry with the back surface 32 of puzzle 12 in order to permanently maintain puzzle 12 in an assembled state. The transparent nature of adhesive sheet 18 permits any message 30 inscribed upon the back surface 32 of puzzle 12 to be plainly seen therethrough. The extended edge 38 of adhesive sheet 18, providing attachment means to card 14, provides an assembly as shown in FIG. 4 in the form of a standard greeting card, with the picture or other indicia provided by the assembled puzzle 12 forming a front cover, the back surface 32 of puzzle 12 providing an interior surface for a message 30, the second side or surface of card 14 providing a second interior surface for an additional message 26, and the first surface 17 of card 14 forming a rear surface of the assembly of FIG. 4 and containing instructions for the assembly as described above.

Figure 4:
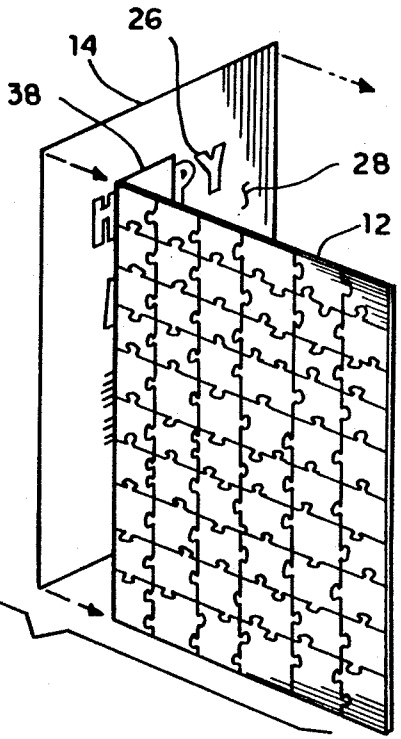
FIG. 4 is an exploded perspective view of the assembled puzzle of FIG. 3, showing the attachment of a message card thereto.
Figure 2:
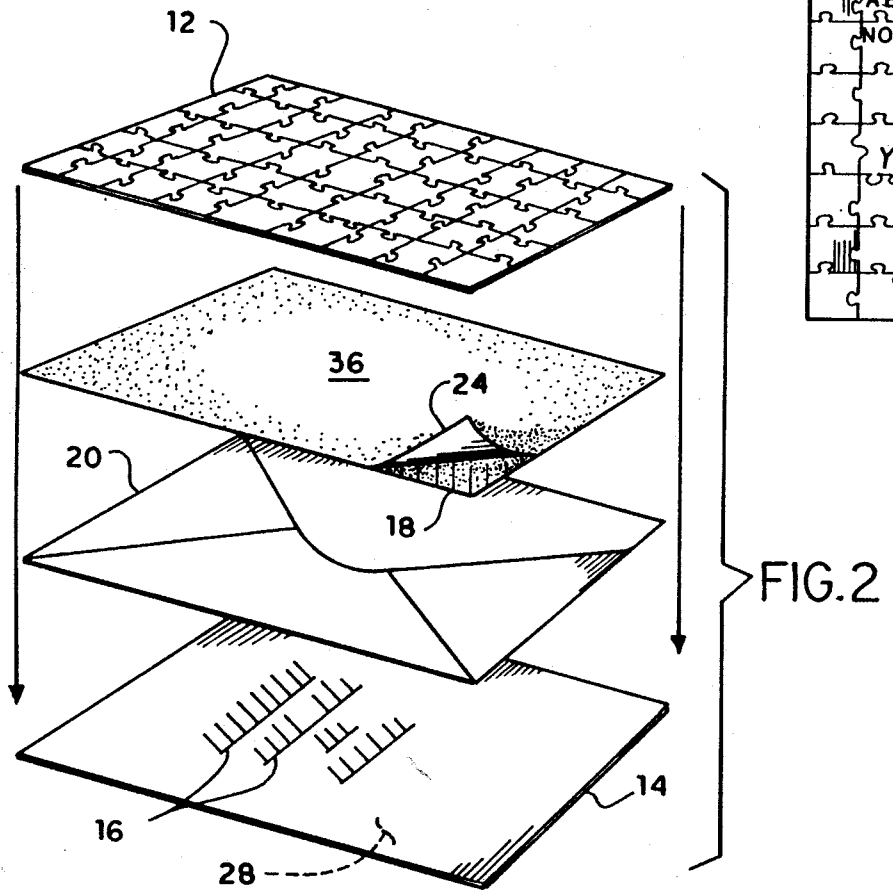
FIG. 2 is an exploded perspective view of the components of FIG. 1, less the exterior wrapping or enclosure.

The assembly of FIG. 4 may be retained or enjoyed as a conventional greeting card, or alternatively the recipient may choose to allow puzzle 12 to be disassembled again by not applying adhesive backing sheet 18 to the assembled puzzle 12. Thus, the reassembly of puzzle 12 may be accomplished at other times or by other persons in the future, in order to continue to enjoy puzzle 12 and its accompanying message 30.

It is to be understood that the present invention is not limited to the sole embodiment described above, but encompasses any and all embodiments within the scope of the following claims.

I claim:

1. A kit comprising a combination of a puzzle and greeting card, said kit including;

an assembled planar puzzle having a first surface and a second surface and comprising a plurality of individual pieces, said puzzle first surface including a picture or other indicia, a card having a first surface including instructions thereupon and a second surface providing space for a message, a transparent adhesive backing sheet having a removable protective covering overlying said adhesive backing and providing for the permanent assembly of said puzzle, an envelope providing for the containment and transmittal of said puzzle, said card and said adhesive backing sheet, and an outer wrapper including said puzzle, said card, said backing sheet, and said envelope.

2. The kit of claim 1 including;

a preprinted message upon said second surface of said card.

3. The kit of claim 1 including;

means for the attachment of said assembled puzzle to said card.

4. The kit of claim 3 wherein;

said means comprise said adhesive backing overlying and adhered to said assembled puzzle with said adhesive backing having an extended edge adhered to said card.

5. The kit of claim 1 including;

means providing for the retention of said puzzle in an assembled state within said kit.

6. The kit of claim 5 wherein;

said means comprise a light, single use adhesive securing said assembled puzzle to said protective cover.

7. The kit of claim 1 wherein;

said wrapper is transparent.

* * * * *